United States Patent [19]

Smith

[11] 4,059,362

[45] Nov. 22, 1977

[54] CONCRETE HIGHWAY TRAFFIC BARRICADE HAVING INTEGRALLY FORMED COUPLING

[76] Inventor: Rodney I. Smith, Rte. No. 1, Midland, Va. 22728

[21] Appl. No.: 744,800

[22] Filed: Nov. 24, 1976

[51] Int. Cl.[2] ..... E01F 15/00

[52] U.S. Cl. ..... 404/6; 256/13.1

[58] Field of Search ..... 404/2, 3, 6, 7, 8, 73; 256/1, 13.1; 52/102, 726, 593, 583, 587

[56] References Cited

U.S. PATENT DOCUMENTS 1,657,012 1/1928 Keddy ..... 404/7

FOREIGN PATENT DOCUMENTS 1,209,646 10/1970 United Kingdom ..... 404/7

*Primary Examiner*—Henry S. Jaudon

*Attorney, Agent, or Firm*—George H. Mitchell, Jr.

[57] ABSTRACT

A highway traffic lane barrier is composed of precast, reinforced concrete barricades which are joined together in alignment with each other by a horizontally and vertically tapered, vertical tongue-and-groove arrangement which is integrally molded on the ends of each barricade, with the wider portion of the taper at the bottom to facilitate the removal of one piece of barrier within an installation.

11 Claims, 5 Drawing Figures

CONCRETE HIGHWAY TRAFFIC BARRICADE HAVING INTEGRALLY FORMED COUPLING

This invention relates to highway median barriers and, more particularly, to the fabrication of a coupling arrangement for traffic barricades of the New Jersey style made of precast, reinforced concrete.

Barriers of this type are widely recognized by highway engineers, safety experts, and the motoring public in general, as the safest, most practical way to separate opposing traffic lanes, where a wide median is not available.

In addition, a general dissatisfaction with wooden barricades composed of 12 by 12 inch wooden beams to which upright planks are nailed, or bolted, which barricades have been used to guide traffic at construction sites has led to the use of concrete barricades for this purpose. These barricades consist essentially of a precast, reinforced concrete block having a uniform cross-section along its length so that a series of barricades can be arranged in abutting alignment to define a traffic lane.

In the preferred form, or New Jersey style, these barricades extend upwardly from the pavement a distance somewhat above the wheels of a passenger vehicle, the upper portion of the barricade being relatively thin as compared to the base of the block with the opposite side walls having only a slight taper away from the vertical in the downward direction. About half way down, they abruptly merge with a lower portion, whose opposite sides slope outwardly and downwardly at a steep angle with respect to the horizontal so that when a vehicle swerves toward the barrier, the wheels coming in contact with the lower portion will be forcefully directed back in the opposite direction. In addition, there will be no tendency for the vehicle to climb over the barrier because of the nearly vertical slope of the upper wall surface.

While the great weight of these concrete barricades (averaging nearly 2½ tons per 12 foot lengths) means that it would take something more than a glancing blow of a vehicle to displace such a barricade, nevertheless, by joining adjacent sections with each other by means of a tapered tongue-and-groove arrangement, a portion of the force of any collision between a vehicle and a barricade is thus transmitted to the adjacent barricades. In other words, there is a continuity of mass with adjacent barrier sections which prevents deflection of individual sections on contact.

Barricades of this type are known, but they exhibit certain disadvantages which limits their practicality for use, particularly in the case of temporary barriers. For example, Italian Patent No. 710,804 discloses a barricade having hooks at the ends of one barricade for engagement with a set of eyes attached to the adjacent barricades. The difficulty with such an arrangement is that horizontal disengagement of the sections is not possible. There must be a precise alignment of the adjacent sections in order for the hooks to engage with the eyes of the adjacent sections. Also, there is only a single point connection between sections which does not prevent any sort of twisting action of one barricade with respect to the next one, and comparitively little force can be transmitted between sections through the connectors. Finally, the placement of the hooks and eyes during the casting process adds to the expense of fabrication and, considering the weight of the sections, there is always a danger of bending the metal connectors during the handling of the concrete sections.

U.S. Pat. No. 3,980,279 discloses a barricade of the New Jersey type having vertical slots at both ends of one barricade to interlock with a tongue element of an adjacent barricade by vertical movement. The tongue and the slot are also formed so as to prevent release in a longitudinal direction. However, there must be precise alignment of one barricade with respect to the other when the barricade is put in place, and the molded connector portions have complex shapes which can be easily damaged during handling of the concrete sections. Expense of manufacturing would make the cost of this arrangement totally prohibitive.

U.S. Pat. No. 3,958,890 also uses a hook and eye arrangement as shown in FIG. 5, or a U-shaped joining cover 28 as shown in FIG. 6. Such an arrangement adds to the complexity of the construction, and is subject to the disadvantages of the Italian Patent design. The use of an additional element also increases cost due to the necessity of stocking the separate parts.

Norwegian Pat. No. 91,989 discloses a system in which the mating of adjacent sections takes place in an axial direction, and specially shaped inserts 1' are employed. In a system of this type it is impossible to remove one of the barricades from a series without destroying at least one of the sections.

French Pat. No. 1,452,861 has been noted, but it is believed that this reference discloses no more than is shown in the references discussed above.

Accordingly, it is an object of the present invention to provide a tapered vertically extending tongue-and-groove arrangement integrally molded at the ends of a precast, reinforced concrete barricade whereby a temporary traffic lane barrier can be constructed rapidly and inexpensively.

It is a further object of the invention to provide a concrete traffic barricade which is provided with integrally molded connector means of the utmost simplicity which enables a traffic barrier formed of a series of said barricades to be disassembled at any point along the length of the barrier by removal of the barricades without the necessity for destroying one of them.

Other objects and advantages will be apparent to those skilled in the art after reading the following description in connection with the annexed drawings, in which.

Figure 1:
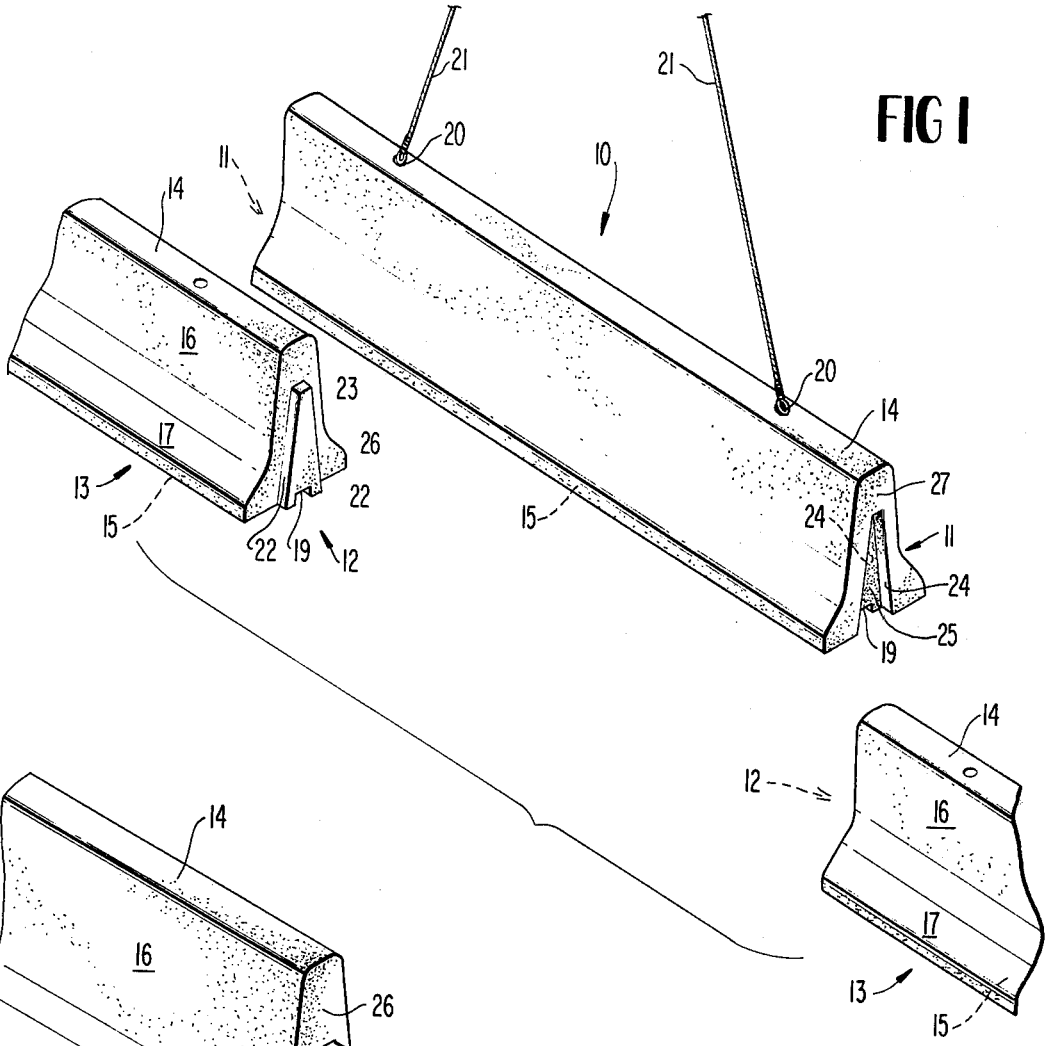
FIG. 1 is an isometric view of a section of a traffic lane barrier showing one of the precast concrete barricades in a raised position between two other aligned barricades supported on the pavement or ground.

In FIG. 1, numeral 10 indicates generally an elongated, precast, reinforced concrete barricade provided at both ends with what might be called the female part, indicated generally by numeral 11, of a two-part interengaging tongue-and-groove coupling, the male part of which coupling, indicated generally by numeral 12, is integrally formed on the end of each of the adjacent concrete barricades, indicated generally by numeral 13.

The transverse configuration of all of the barricades 10 and 13 is substantially identical so that when they are installed in end to end alignment, there are no dangerous outwardly projecting obstructions which would tear through the body of a vehicle which accidentally comes in contact with the barrier.

The configuration, which is known in the highway construction trade as the New Jersey style, consists of a top surface 14 which is relatively narrow compared with the width of the base 15. The upper side walls 16 taper outwardly at a slight angle with the vertical and are abruptly joined to the lower side walls 17 which extend downwardly at a fairly high angle with respect to the horizontal for slightly less than one half of the height of the barricade.

Figure 5:
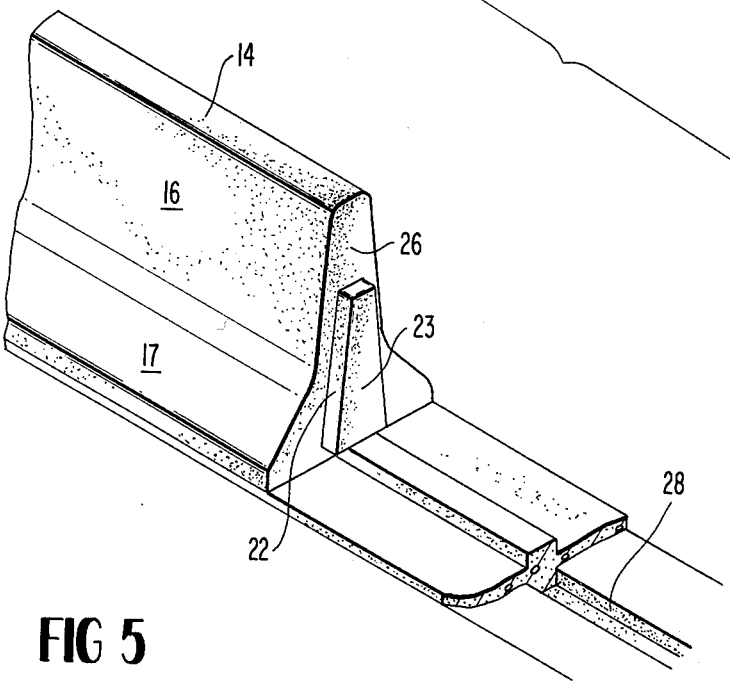
FIG. 5 is an isometric view showing the method of employing grouting for the installation of a permanent highway barrier.
Figure 4:
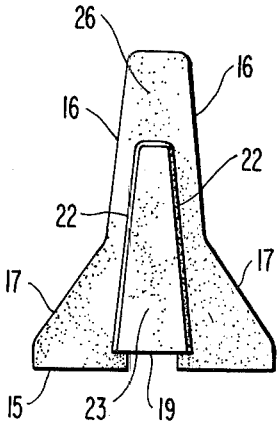
FIG. 4 is an end view of the barricade of FIG. 3 showing one part of the two-part coupling which joins each pair of barricades.
Figure 3:
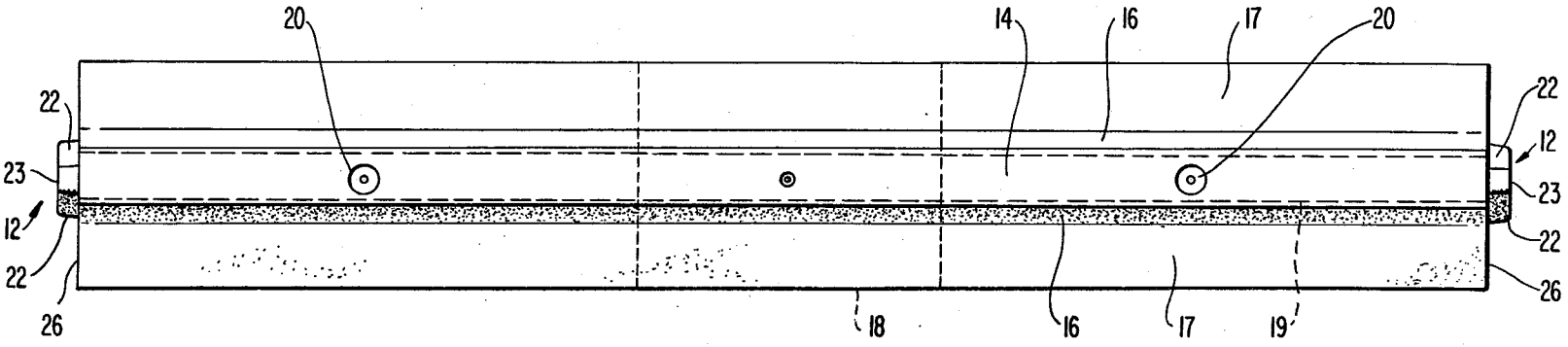
FIG. 3 is a plan view of a barricade of the type shown adjacent the raised barricade in FIG. 1.
Figure 2:
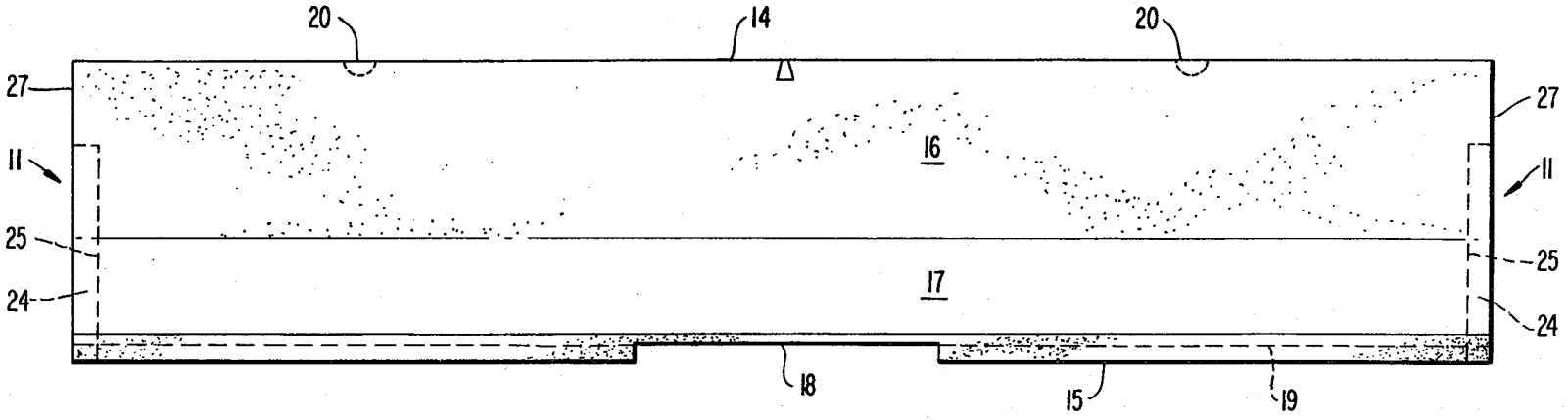
FIG. 2 is a view in elevation of the raised barricade shown in FIG. 1.

If the barricade is intended for use in the establishing of a temperary traffic lane, such as when vehicles are being rerouted during construction, a transverse drainage slot 18 may be provided in the base 15 midway between the ends of the barricade to prevent a backup of surface water on one side or the other, and a longitudinally extending keyway 19 may also be provided in the base for use when the barricades are embedded in grouting, as shown in FIG. 5, for construction of a permanent barrier between opposing lines of traffic on a completed highway. A pair of Swift-Lift inserts 20 may be embedded in the top of the barricade for detachable connection with cables 21 of a hoisting crane (not shown).

As stated above, the recess 11 and projection 12, integrally molded on the ends of barricades 10 and 13, respectively, comprise the two-part of a tongue-and-groove coupling between adjacent coupling, and, in order to facilitate the joining of a barricade 10 with a pair of barricades 13, which are already in place, the side walls 22 of the projecting tongue 23, and the complementary mating side walls 24 of the groove, or recess, 25 are outwardly inclined in a downward direction. Furthermore, the walls 22 are also slightly inclined inwardly as they extend horizontally away from the end wall 26, and mating walls 24 are correspondingly inclined inwardly as they extend horizontally inwardly from the end wall 27.

The advantages of the tapering of the side walls of the coupling may be judged from the fact that a typical precast concrete barricade of the type described will be about 12 feet long, 2 feet wide at the base, 2 feet 8 inches high, and will weigh in the neighborhood of 4800 pounds. Thus, there are tremendous masses that must be guided into position by one or two people while suspended by a crane under the control of another person. In the present case, the mating side walls 22 and 24 are spaced apart about $2\frac{1}{2}$ inches at their upper ends and approximately 8 inches at their lower ends, so that the barricade 10 need not be in absolute alignment with the adjacent barricades 11 as it is lowered into position. Any misalignment will be automatically corrected as the groove 25 slides downwardly on the tongue 23. Similiarly, the slight horizontal taper of the mating side walls assists in the assembly if, instead of being lowered into position between a pair of barricades already in place, the barrier is being initially assembled by the successive emplacement of barricades into horizontal alignment with previously placed barricades. This taper also allows for placement of barricades around a normal curve often encountered in highway construction.

When a barrier is to be constructed as a permanent installation, it is only necessary to form a keyway 28 in the pavement when it is originally laid, or to construct it with a jackhammer in the case of a previously laid pavement, which keyway correspondes with the keyway 19 in the bottom of the barricades. Just prior to barricade placement, a continuous ribbon of mortar is extruded into and over the pavement keyway as shown in FIG. 5. The barricades are then placed in the wet mortar, sometimes with the aid of small blocks or shims to aid in vertical alignment. The full length keyways act in combination with the vertical tongue-and-groove couplings to form a rigid, permanent installation in which any force exerted horizontally against the side of any one of the barricades is absorbed not only by the weight and mass of that barricade, but also partially absorbed by the adjacent barricades with which it is connected.

In summary, this invention provides for the first time a precast concrete barrier that can be easily removed both vertically or horizontally from adjacent sections for ease of replacement or redirection of traffic. Also, for the first time, this can be done without fixtures that make prior barricades impractical because of high cost. Using this new and most simplified practical design, the cost has been brought, for the first time, within highway department budget requirements.

What is claimed is:

1. In a traffic barrier of the type wherein a series of elongated precast concrete barricades having a uniform cross-section along their respective lengths are joined in end-to-end interengaging, abutting alignment by similar mating tongue-and-groove couplings integrally formed in the respective abutting ends of each of the barricades, each tongue-and-groove coupling consisting of a vertically elongated tongue projecting longitudinally outwardly from the end of one of the abutting barricades and a recess complementary to said tongue being formed in the end of the other of the abutting barricades, said recess extending downwardly to the base of the barricade to permit entrance of the tongue in a vertical direction, the transverse width of the tongue and the recess being greater at their lower ends than at their upper ends to facilitate said entrance.

2. The invention as defined in claim 1, wherein the side walls of the tongue and the recess are smoothly outwardly tapered in a downward direction.

3. The invention as defined in claim 2, wherein the side walls of the tongue are also inwardly tapered in a horizontally outwardly extending direction to facilitate entrance of the tongue into a recess in a horizontal direction.

4. The invention as defined in claim 1, wherein at least one of said series of precast barricades is provided with a recess at both ends for engagement with a tongue provided at the abutting ends of the adjacent barricades in said series whereby said one barricade may be removed from the barrier without disturbing the adjacent barricades.

5. The invention as defined in claim 4, wherein said series of precast barricades comprises equal numbers of first barricades having recesses provided at both of their ends and second barricades having tongues provided at both of their ends whereby any of said first barricades can be removed without disturbing another barricade and one of the second barricades can be removed by removal of an adjacent furst barricade without damage.

6. In a precast reinforced concrete barricade for use in the construction of a highway lane barrier composed of a plurality of said barricades joined by mating two-part couplings in endwise alignment, said barricade being elongated and having a generally symmetrical cross-section along its length, the top surface being relatively narrow compared to the width of the base, the upper portions of the side surfaces being nearly vertical and the lower side surfaces being abruptly outwardly flared at an angle to deflect a vehicle wheel away from the barricade, the improvement which comprises the same one part of said two-part coupling being integrally molded on each end of said barricade, said one part having vertically elongated side walls terminating at the base of the barricade and being outwardly and downwardly inclined.

7. The invention as defined in claim 6, wherein said one part of the two-part mating coupling ingetrally formed on each end of the barricade consists of a tapered groove.

8. The invention as defined in claim 6, wherein said one part of the two-part mating coupling integrally formed on each end of the barricade consists of a tapered tongue.

9. The invention as defined in claim 8, wherein the side walls of the tapered tongue are also horizontally inwardly inclined in an outwardly extending direction.

10. The invention as defined in claim 6, wherein a longitudinally extending keyway is formed in the under surface of the barricade.

11. The invention as defined in claim 6, wherein a transverse drainage slot is formed in the under surface of the barricade medially of the ends thereof.

* * * * *